US009470170B2

(12) United States Patent
Tanaka

(10) Patent No.: US 9,470,170 B2
(45) Date of Patent: Oct. 18, 2016

(54) FUEL INJECTION DEVICE FOR ENGINE OF MOTORCYCLE

(71) Applicant: SUZUKI MOTOR CORPORATION, Shizuoka-Ken (JP)

(72) Inventor: Koichi Tanaka, Shizuoka-Ken (JP)

(73) Assignee: SUZUKI MOTOR CORPORATION, Shizuoka-Ken (JP)

( * ) Notice: Subject to any disclaimer, the term of this patent is extended or adjusted under 35 U.S.C. 154(b) by 73 days.

(21) Appl. No.: 14/257,434

(22) Filed: Apr. 21, 2014

(65) Prior Publication Data

US 2014/0318499 A1 Oct. 30, 2014

(30) Foreign Application Priority Data

Apr. 25, 2013 (JP) ..... 2013-092692

(51) Int. Cl.

| | |
|---|---|
| ***F02M 51/00*** | (2006.01) |
| ***F02M 35/10*** | (2006.01) |
| ***F02D 41/30*** | (2006.01) |
| ***F02M 69/04*** | (2006.01) |
| ***F02D 11/10*** | (2006.01) |
| *F02D 9/10* | (2006.01) |

(52) U.S. Cl.

CPC ..... *F02D 41/30* (2013.01); *F02D 11/10* (2013.01); *F02D 41/3094* (2013.01); *F02M 69/043* (2013.01); *F02M 69/044* (2013.01); *F02D 9/107* (2013.01)

(58) Field of Classification Search

CPC .... F02D 11/10; F02D 41/30; F02D 41/3094; F02D 9/107; F02M 69/043; F02M 69/044

See application file for complete search history.

(56) References Cited

U.S. PATENT DOCUMENTS 4,759,320 A * 7/1988 Fujii ..... F02B 27/02 123/184.55
4,890,586 A * 1/1990 Fujii ..... F02B 27/0231 123/184.55
D340,933 S * 11/1993 Karlsson ..... D15/5

(Continued)

FOREIGN PATENT DOCUMENTS

JP 2002256895 A 9/2002
JP 2002256896 A 9/2002

(Continued)

OTHER PUBLICATIONS

JP 2007-9881 translation.*

*Primary Examiner* — Marguerite McMahon
*Assistant Examiner* — Tea Holbrook
(74) *Attorney, Agent, or Firm* — Barnes & Thornburg LLP

(57) ABSTRACT

A motorcycle engine having cylinders arranged in parallel in a vehicle width direction, an air cleaner, a fuel tank arranged above the engine to cover the air cleaner, and a fuel injection device. The fuel injection device includes an electronic control throttle body unit electrically controlling a throttle body of the engine; an intake passage of down draft intake structure connecting the air cleaner and a combustion chamber of the engine in each of the cylinders; fuel injectors provided at the intake passage including a first fuel injector located on an intake downstream side and a second fuel injector located on an intake upstream side; and a drive motor of the electronic control throttle body unit arranged between the intake passage and the fuel tank and arranged on a same side as the first fuel injector and the second fuel injector and between the first and second fuel injectors.

5 Claims, 6 Drawing Sheets

(56) References Cited

U.S. PATENT DOCUMENTS 5,937,815 A * 8/1999 Hidaka ..... F02B 27/02 123/184.56
6,450,141 B1 * 9/2002 Sakuma ..... F02D 9/1025 123/184.56
6,886,532 B2 * 5/2005 Nohara ..... F01L 1/024 123/184.42
8,245,674 B2 * 8/2012 Maehara ..... F01L 1/25 123/193.3
8,770,166 B2 * 7/2014 Tucker ..... F02M 35/108 123/184.56
2001/0050193 A1 * 12/2001 Yoshida ..... F01M 13/04 180/219
2002/0050268 A1 * 5/2002 Deguchi ..... F02D 9/02 123/336
2010/0243365 A1 * 9/2010 Mori ..... B60K 5/04 180/292
2011/0011373 A1 * 1/2011 Shimura ..... F02D 41/3082 123/497
2011/0174273 A1 * 7/2011 Otsuka ..... F02M 35/10032 123/470
2011/0308874 A1 * 12/2011 Tanaka ..... B60K 15/03504 180/219
2012/0073252 A1 * 3/2012 Lee ..... F02M 35/02491 55/385.3
2012/0265423 A1 * 10/2012 Kai ..... F02D 41/30 701/104
2013/0306044 A1 * 11/2013 Tanaka ..... F02M 25/06 123/573

FOREIGN PATENT DOCUMENTS

JP 2005016391 A 1/2005
JP 2007-9881 * 1/2007
JP 2009103137 A 5/2009

* cited by examiner

FUEL INJECTION DEVICE FOR ENGINE OF MOTORCYCLE

PRIORITY CLAIM

This patent application claims priority to Japanese Patent Application No. 2013-092692, filed 25 Apr. 2013; the disclosure of which is incorporated herein by reference in its entirety.

BACKGROUND OF THE INVENTION

1. Field of the Invention

The present invention relates to a fuel injection device for an engine of a motorcycle in which a drive motor of an electronic control throttle body unit and a plurality of fuel injectors are arranged by utilizing a dead space formed between a fuel tank and an air cleaner.

2. Description of the Related Art

In general, in a motorcycle, an intake amount (volume) of an engine is controlled by a throttle body, and in a known art, the throttle body is controlled such that an accelerator operation and a throttle valve motion are operated in synchronism with each other by mechanically connecting an accelerator lever of a handle and a throttle valve.

However, in the motorcycle in which the accelerator grip of the handle and the throttle valve are mechanically connected together, the throttle valve is disadvantageously delayed in motion. Thus, it is difficult to improve discharge gas emission performance, safety or the like. In order to allow the throttle valve motion to quickly respond to the accelerator operation, an electronic control throttle body unit that electrically controls the throttle valve by a drive motor has been developed.

Meanwhile, some motorcycles include a fuel injection device as a device for supplying a fuel-air mixture to an engine of the motorcycle so as to respond to needs of engine characteristics and traveling performance. In such fuel injection device, sensors detect, as information, a throttle opening degree, an engine speed, an engine temperature, an outside air temperature, an atmospheric pressure or the like, and a computer (controller) processes the above information. The fuel injection device thereby directly injects a most appropriate required amount of fuel to an intake passage of the engine by using a fuel injector. Fuel efficiency and engine power can be improved. Since only the minimum required amount of fuel is injected, a fuel injection amount can be also decreased.

The electronic control throttle body unit is provided for the fuel injection device for the engine of the motorcycle in some cases as described in Patent Documents 1 and 2 (Japanese Patent Laid-Open Publication Nos. 2002-256896 and 2002-256895). The electronic control throttle body unit electrically controls the throttle valve by using an electronic control throttle drive motor operated in association with the accelerator lever. In the electronic control throttle body unit, arrangement of the drive motor and the fuel injector is considered to be important in order to achieve reductions in vehicle size and weight as well as favorable fuel performance.

When the engine speed varies largely and frequently as in the motorcycle, only one fuel injector may not sufficiently supply fuel in an amount required for the operation of the engine. Thus, a plurality of fuel injectors are arranged in the throttle body so as to constitute an intake passage, or in the vicinity thereof in some cases so as to supply a sufficient amount of fuel (Patent Documents 3 or 4 (Japanese Patent Laid-Open Publication Nos. 2009-103137 and 2005-16391)).

The Patent Document 1 discloses a drive motor arranged between a cylinder head and an air cleaner in an engine of a motorcycle, and hence, a filter of the air cleaner has a smaller size, so that filter purification performance is be deteriorated. In addition, since a fuel injector is arranged in a throttle body, fuel is injected from a position apart from an intake valve of the engine, and an engine speed response to a throttle valve operation is thereby lowered, thus being disadvantageous.

The Patent Document 2 discloses a fuel injector and a drive motor arranged on the same side surface of a throttle body. Thus, a throttle valve is arranged apart from an intake valve of an engine, and accordingly, an engine speed response to a throttle valve operation is also lowered, thus being disadvantageous.

Both the inventions described in the Patent Documents 1 and 2 do not include two fuel injectors.

On the other hand, the Patent Documents 3 and 4 disclose a second fuel injector that is arranged within an air cleaner above an air funnel. According to such arrangement, although capacity of the air cleaner is decreased, the second fuel injector blocks a flow of intake air, thereby possibly deteriorating an intake inertia effect and reducing (decreasing) engine power. Moreover, since the second fuel injector injects the fuel within the air cleaner, a lot of spray is scattered in the air cleaner due to spitback from the engine or a disturbance of the intake air. Thus, an inner portion of the air cleaner is contaminated, or much fuel is adhered thereto, resulting in a deterioration of fuel consumption and thus, being disadvantageous.

SUMMARY OF THE INVENTION

The present invention has been made in consideration of the circumstances mentioned above, and an object of the present invention is to provide a fuel injection device for an engine of a motorcycle which can improve a purification function of an air cleaner and engine power, and can improve motor driving performance by efficiently arranging a drive motor for an electronic control throttle body unit and first and second fuel injectors by effectively utilizing a dead space in a motorcycle having a passage of down draft intake type structure (called hereinafter "down draft intake structure").

Another object of the present invention is to provide a fuel injection device for an engine of a motorcycle which can maintain knee grip performance without enlarging a fuel tank in a vehicle width direction, and can improve engine controllability, power feel, and emission performance by concentrically arranging a drive motor and first and second fuel injectors on a same side of an electronic control throttle body on the fuel tank side to thereby shorten a fuel pipe, decrease fuel pressure pulsation and stabilize a fuel injection amount.

The above and other objects can be achieved according to the present invention by providing a fuel injection device for an engine of a motorcycle including an engine in which a plurality of cylinders are arranged in parallel with each other in a vehicle width direction, an air cleaner, a fuel tank arranged above the engine so as to cover the air cleaner, and a fuel injection device. The fuel injection device includes: an electronic control throttle body unit electrically controlling a throttle body of the engine; an intake passage of down draft intake structure connecting the air cleaner and a combustion chamber of the engine in each of the cylinders and extending from an air funnel incorporated in the air cleaner to an intake port of a cylinder head of the engine through the electronic control throttle body device; a plurality of fuel injectors provided at the intake passage including a first fuel injector located on an intake downstream side and a second fuel injector located on an intake upstream side; and a drive motor of the electronic control throttle body unit arranged between the intake passage and the fuel tank and arranged on a same side as the first fuel injector and the second fuel injector and between the first and second fuel injectors, the drive motor being further arranged between throttle valves located at both outer side ends in the vehicle width direction of the engine.

According to the fuel injection device for an engine of a motorcycle, it is possible to improve a purification function of an air cleaner and engine power, and further improve motor driving performance and vehicle running performance by efficiently concentrically arranging the drive motor of the electronic control throttle body unit and first and second fuel injectors to thereby concentrate a mass and ensure a sufficient capacity of the air cleaner and a sufficient intake inertia effect by effectively utilizing a dead space formed between the fuel tank and the air cleaner in a motorcycle of down draft intake structure.

The fuel injection device for an engine of a motorcycle of the present invention can also maintain knee grip performance without enlarging the fuel tank in the vehicle width direction, and improve engine controllability, power feeling, and discharge gas emission performance by arranging the drive motor and first and second fuel injectors on the same side of an electronic control throttle body on the fuel tank side to thereby shorten a fuel pipe and stabilize a fuel injection amount.

The nature and further characteristic features of the present invention will be made clearer from the following descriptions made with reference to the accompanying drawings.

DESCRIPTION OF THE PREFERRED EMBODIMENT

In the following, an embodiment of the present invention is described with reference to the accompanying drawings. It is further to be noted that terms "upper", "lower", "right", "left" and the like terms indication direction or like are used herein with reference to the illustrated state or actual mount state for a motorcycle.

Figure 1:
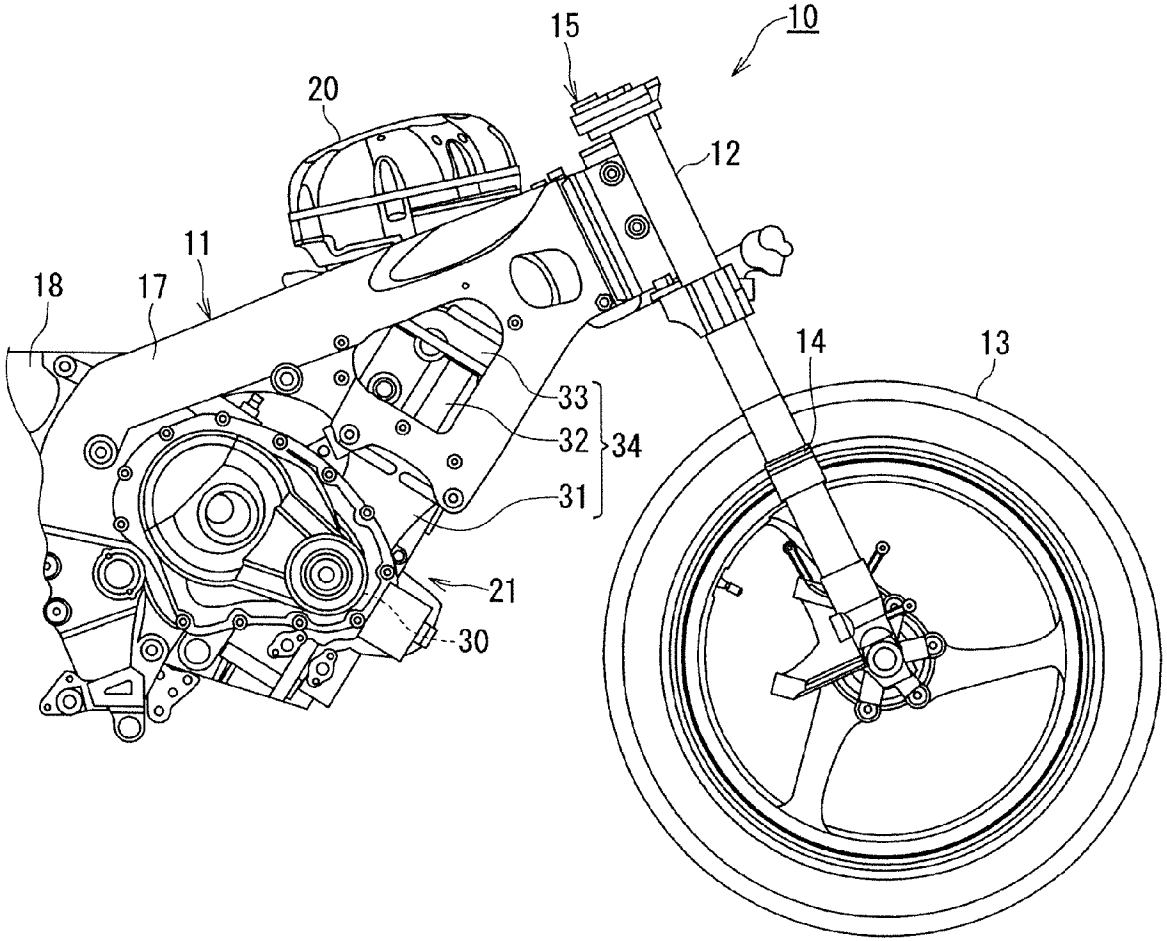
FIG. 1 is a right side view illustrating a front portion of a motorcycle from which a handle and a fuel tank are removed.

With reference to FIG. 1, a motorcycle 10 is provided with a vehicle body frame 11, and a head pipe 12 is provided at a front end portion of the vehicle body frame 11. A pair of right and left front forks 14 that pivotally support a front wheel 13, and a steering mechanism 15 including a handlebar, not shown, are provided for the head pipe 12. The front wheel 13 is steered pivotally rightward and leftward by operating the handlebar.

The vehicle body frame 11 is of, for example, twin-tube type. The vehicle body frame 11 mainly includes the head pipe 12, a pair of right and left main frames 17, and a pair of right and left seat rails 18. An interval between the pair of right and left main frames 17 is widened rightward and leftward just after the head pipe 12. The pair of right and left main frames 17 once extend obliquely downward to a rear side in parallel with each other, and then extend downward rearward. The pair of right and left seat rails 18 are attached to a rear bent portion of the main frames 17, and extend to the rear side. A driver seat, not shown, is arranged above the seat rails 18 to be detachable or freely opened and closed.

Figure 2:
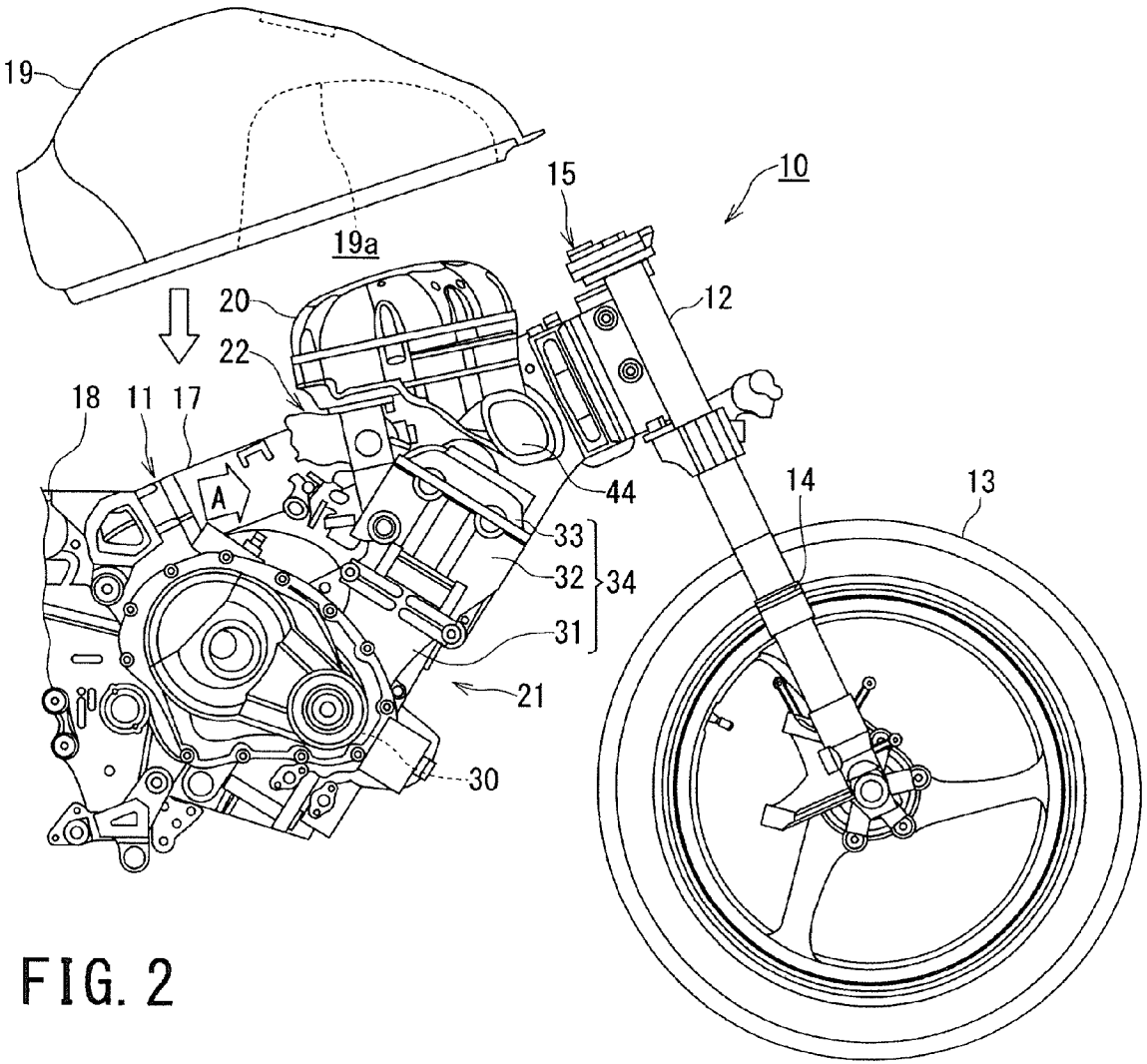
FIG. 2 is a right side view of the front portion of the motorcycle illustrating a fuel tank mounted in the front portion of the motorcycle in FIG. 1, and from which a right-side main frame is removed.

FIG. 2 shows the front portion of the motorcycle 10 where the right-side main frame is removed from the vehicle body frame 11.

With reference to FIG. 2, an accommodating concave portion 19*a* of a fuel tank 19 is arranged above the right and left main frames 17 so as to cover an air cleaner 20. A four-cycle multi-cylinder engine 21, in which a plurality of cylinders, e.g., four cylinders, are arranged in parallel with each other in a vehicle width direction, is mounted below the fuel tank 19 that covers the air cleaner 20.

Figure 3:
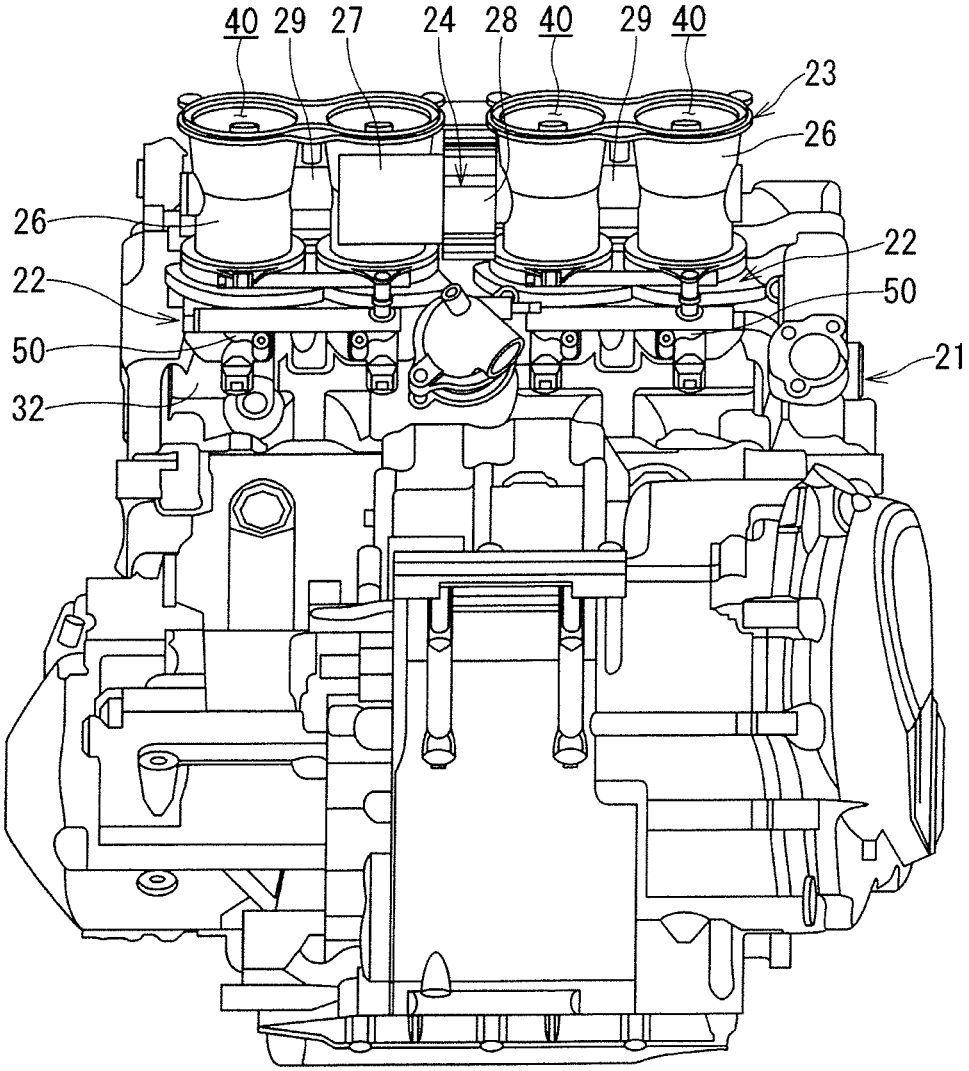
FIG. 3 is a rear view of an engine of the motorcycle as viewed in a direction of an arrow "A" in FIG. 2.
Figure 4:
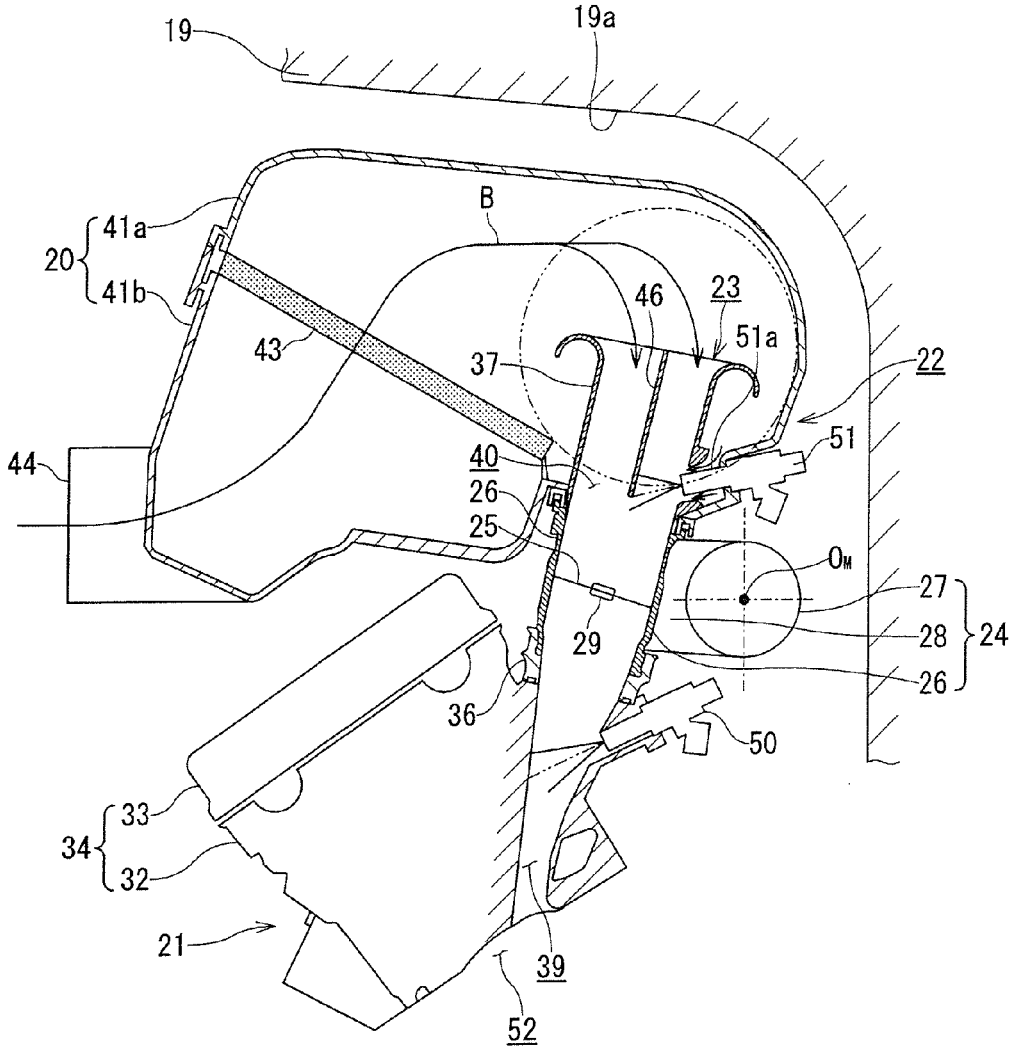
FIG. 4 is a view illustrating configuration of an embodiment of a fuel injection device for the engine of the motorcycle according to the present invention.

FIG. 3 is a rear view of a four-cycle parallel four-cylinder engine (referred to as engine hereinafter) as a view of the multi-cylinder engine 21 shown in FIG. 2 as viewed in a direction of an arrow "A", in which a fuel injection device 22 for the engine is provided in the motorcycle 10 as shown in FIG. 4.

In the fuel injection device 22 for the engine 21, an electronic control throttle body unit (device) 24 is provided in an engine intake system 23 as shown in FIG. 4. The electronic control throttle body unit 24 includes a throttle body 26, a drive motor 27, and a controller, not shown. The throttle body 26 incorporates a throttle valve 25. The drive motor 27 operates to open and close each throttle valve 25. The controller controls the driving of the drive motor 27 in response to throttle operation detection signals from various sensors.

The drive motor 27 is accommodated within a motor housing, and driving power of the drive motor 27 is transmitted to a valve stem 29 of the throttle valve 25 via a reduction gear mechanism incorporated in a gear case 28. The drive motor 27 thereby operates to open or close the throttle valve 25. The electronic control throttle body unit 24 integrally includes the drive motor 27, the gear case 28 incorporating the reduction gear mechanism, and the throttle body 26 incorporating the throttle valve 25.

Meanwhile, as shown in FIGS. 1 to 3, in the engine 21, a cylinder assembly 34 extending obliquely upward from a vehicle front side of a crankcase 30 integrally includes a cylinder block 31, a cylinder head 32, and a head cover 33. The electronic control throttle body unit 24 is mounted at a rear upper portion of the cylinder head 32 of the engine 21 via a joint pipe 36 as an intake pipe as shown in FIG. 4.

An air funnel 37 is connected to an intake upstream side of the throttle body 26. The air funnel 37 is incorporated in the air cleaner 20. An intake passage 40 of down draft intake structure is thereby formed from the air funnel 37 incorporated in the air cleaner 20 to an intake port 39 of the cylinder head 32 through the throttle body 26 of the electronic control throttle body unit 24 and the joint pipe 36 as an intake pipe.

The air cleaner 20 is formed in a box-shape with an upper cleaner case 41*a* and a lower cleaner case 41*b* coupled in a dividable manner. A filter 43 is provided so as to cross an air flow path within the air cleaner 20. The filter 43 divides the interior of the air cleaner 20 into a dirty-side chamber provided with an air suction port 44 on a vehicle front side, and a clean-side chamber provided with the air funnel 37.

The air funnel 37 is accommodated in the clean-side chamber of the air cleaner 20. Air sucked into the air cleaner 20 from the air suction port 44 is purified by the filter 43, and then guided in a substantially inverted U-shape as indicated by an arrow "B" to an inlet of the air funnel 37 through the air flow path in the clean-side chamber.

A partition wall 46 that divides the intake air is arranged in the air funnel 37 in parallel with the vehicle width direction of the motorcycle 10. The partition wall 46 is provided so as to extend in an axial direction of the air funnel 37 from the inlet to an air outlet thereof as shown in FIG. 4. In the intake passage 40 of the down draft intake structure, a first fuel injector 50 as a main fuel injector is arranged on an intake downstream side, and a second fuel injector 51 as a sub-fuel injector is arranged on an intake upstream side.

The first fuel injector 50 is arranged between the cylinder head 32 and the fuel tank 19, and fixed to the cylinder head 32 so as to inject fuel into the intake port 39 of the cylinder head 32. It is preferred for the first fuel injector 50 to be arranged close to an intake valve, not shown, that is, close to a combustion chamber 52 in the intake port 39 of the cylinder head 32. The first fuel injector 50 is further arranged on the vehicle front side relative to a rotation center axis $O_M$ of the drive motor 27. Accordingly, the throttle valve 25 of the throttle body 26 can be located closer to the intake valve of the cylinder head 32, thereby improving an engine response. When the first fuel injector 50 is arranged closer to the cylinder head 32, the motorcycle 10 can be reduced in weight with a concentrated mass.

Figure 5:
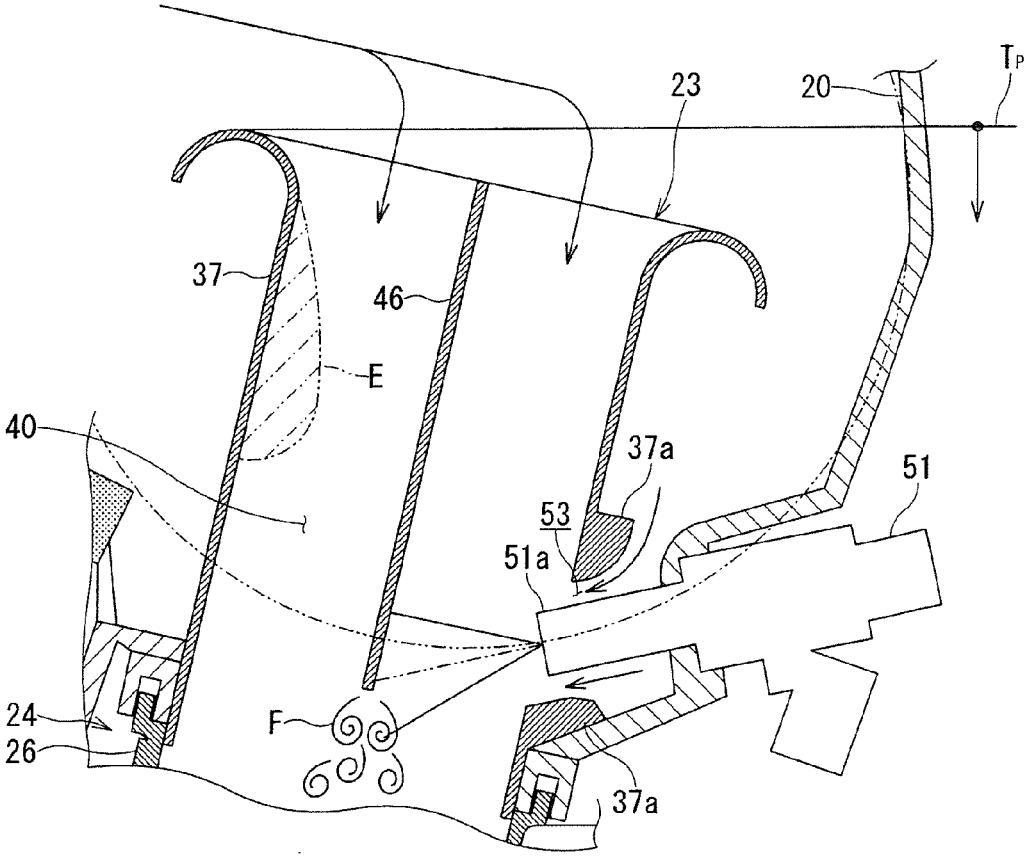
FIG. 5 is an explanatory view illustrating an attachment relationship between an air funnel and a second fuel injector in the fuel injection device for the engine of the motorcycle shown in FIG. 4.

The second fuel injector 51 is arranged on a rear side surface of the air cleaner 20 in vehicle side view, and below an upper end Tp of the air funnel 37 to be closer to the cylinder head 32 of the engine 21 than the upper end Tp as shown in FIGS. 4 and 5. The second fuel injector 51 is arranged in a manner such that an injector nozzle 51*a* penetrates the upper cleaner case 41*a* and the air funnel 37 from a vehicle rear side so as to inject a fuel spray into the air funnel 37.

The second fuel injector 51 is arranged on the same rear side surface of the intake passage 40 as the first fuel injector 50 and below the upper end of the air funnel 37 between the intake passage 40 and the fuel tank 19. Therefore, an effective capacity of the air cleaner 20 on the intake upstream side of the air funnel 37 can be increased.

The fuel spray injected from the second fuel injector 51 can be directly supplied into the air funnel 37, thereby preventing the fuel spray from scattering into the air cleaner 20, and thus, reliably preventing the contamination of the air cleaner 20.

The drive motor 27 of the electronic control throttle body unit 24 is also arranged between the intake passage 40 and the fuel tank 19. The drive motor 27 is further arranged on the same rear side surface of the intake passage 40 as the first and second fuel injectors 50 and 51 and between the two fuel injectors 50 and 51. According to the arrangement of the drive motor 27 and the two fuel injectors 50 and 51 on the same rear side of the intake passage 40, it becomes possible to shorten the length of the fuel pipe, not shown, from the fuel tank 19, thereby decreasing the fuel pressure pulsation.

When the fuel pressure pulsation is decreased, a fuel injection amount is stabilized, and consequently, the engine control performance, power feeling, and emission performance can be improved. The maintenance performance of the engine can be also easily improved.

Furthermore, since the drive motor 27 of the electronic control throttle body unit 24 is arranged between the intake passage 40 and the fuel tank 19, a dead space is inevitably formed between the air cleaner 20 and the fuel tank 19 in the motorcycle 10 of down draft intake structure and this dead space can be effectively utilized. When the drive motor 27 is arranged on the rear side of the intake passage 40, the drive motor 27 is located away from the cylinder head 32 of the engine 21. Thus, ambient environmental atmosphere temperature is lowered, an applied current can be increased, and the motor driving performance can be improved.

In addition, the drive motor 27 and the two fuel injectors 50 and 51 are also arranged in tandem along the intake passage 40 of down draft intake structure. Accordingly, a gap between the engine 21 and the fuel tank 19 can be filled, and the mass can be concentrated, thereby improving the vehicle traveling stability.

Meanwhile, in the fuel injection device 22 for the engine of the motorcycle 10 according to the present embodiment, the drive motor 27 is arranged at a position where the capacity of the air cleaner 20 is not affected. The second fuel injector 51 also does not block a flow in the air flow path within the air cleaner 20. Thus, in association with the maximization of an area of the cleaner filter 43, a sufficient volume of purified air can be ensured. Consequently, the engine power can be improved, and the purification performance of the air cleaner filter 43 can be also improved.

In the present embodiment, the drive motor 27 of the electronic control throttle body unit 24 is arranged between the right and left throttle bodies 26 and 26 as shown in FIG. 3, so that the fuel tank 19 can be shaped without increasing a vehicle widthwise length thereof. Accordingly, the fuel tank 19 can be formed in the tank shape in a manner of not impairing the knee grip performance of the motorcycle 10.

Incidentally, in the fuel injection device 22 for the engine of the motorcycle 10, the partition wall 46 that divides intake air within the air funnel 37 is provided at a position exposed to the fuel spray from the second fuel injector 51, and atomization of the fuel spray, and the fuel mixing with a main stream of the intake air are thereby encouraged. The partition wall 46 is arranged in parallel with the vehicle width direction in the vehicle side view such that the main stream of the intake air passing through the air cleaner 20 is not deflected in the air funnel 37.

The partition wall 46 is offset to the vehicle rear side with respect to a center line of the intake passage 40 such that the flow velocity of the intake air divided by the partition wall 46 differs on right and left sides of the partition wall 46 from each other. Because of such reason, with the sectional area of the intake passage 40 in the air funnel 37, a sectional area "C" of the passage 40 on the vehicle front side is larger than a sectional area "D" of the passage 40 on the vehicle rear side.

Furthermore, the main stream of the intake air passing through the air cleaner 20 is guided to the intake passage 40 in the air funnel 37. A flow ratio between the (funnel) main stream of the intake air and a sub stream of the air guided to the outside of the air funnel 37 is basically set to be substantially 1:1. When the fuel spray from the second fuel injector 51 adheres to the partition wall 46, it is preferred to increase the flow velocity of the funnel main stream passing near the second fuel injector 51 so as to blow off the adhered liquid.

An annular or sleeve-like gap 53 is provided between a boss-shaped cover wall 37*a* and the injector nozzle 51*a* of the second fuel injector 51 so as to surround the injector nozzle 51*a* in an insertion portion for the injector nozzle 51*a* of the air funnel 37 as shown in FIG. 5. The formation of the annular gap 53 encourages the mixing of the fuel spray injected from the second fuel injector 51 due to a difference in the flow velocity between the sub stream sucked from the back side of the second fuel injector 51 and the main stream of the intake air in the air funnel 37.

Moreover, the sub stream of air sucked from the back side of the second fuel injector 51 through the annular gap 53 is actively accelerated, sucked, and blown out by an ejector effect caused by the main stream (of the intake air) in the air funnel passing through the intake passage 40 of the air funnel 37 near the second fuel injector 51, thereby facilitating the mixing between the main stream and the sub stream in the air funnel 37 due to the difference in flow velocity. Accordingly, the mixing of the fuel spray injected from the second fuel injector 51 can be facilitated.

Meanwhile, if the partition wall 46 is not provided within the air funnel 37, the main stream of the intake air passing through the air cleaner 20 is deflected in the air funnel 37 to generate a separation area "E" of the flow on the vehicle front side within the air funnel 37 as indicated with the two-dot chain line in FIG. 5. Thus, the pressure loss of the main stream is increased as compared to the case in which the partition wall 46 is provided. When the partition wall 46 is not provided, the flow velocity on the vehicle front side in the air funnel 37 is also decreased. Thus, it is difficult to blow off the fuel adhering to a wall surface, and the controllability of the engine throttle body unit is deteriorated.

On the other hand, according to the present embodiment, in the case when the partition wall 46 is provided in the air funnel 37, the flow velocity of the intake air at the wall surface to which the spray is adhered is increased, thereby improving the controllability.

Moreover, since the partition wall 46 is arranged at the offset position in a manner such that the flow velocity of the main stream of the intake air divided by the partition wall 46 differs on the right and left sides of the partition wall 46, a vortex flow separated at the lower end of the partition wall becomes higher in flow strength, and the mixing of the fuel spray is further facilitated by the separated vortex flow "F".

Figure 6:
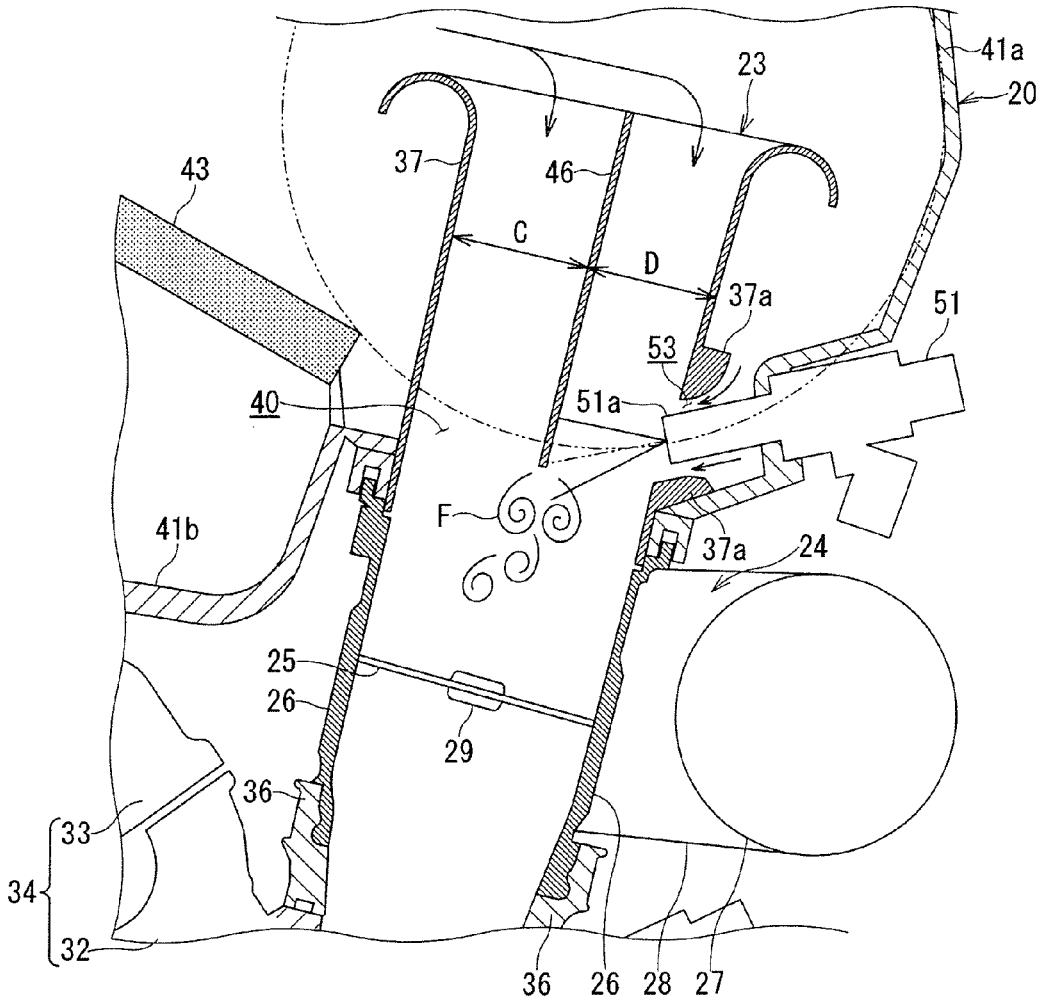
FIG. 6 is an explanatory view illustrating an arrangement relationship between a partition wall in the air funnel and the second fuel injector in the fuel injection device for the engine of the motorcycle shown in FIG. 4.

The flow velocity of the main stream of the intake air is set in a manner such that a ratio C:D of the flow velocity of the intake air on the right and left sides of the partition wall 46 is, for example, 6:4 as shown in FIG. 6.

As described above, in the fuel injection device 22 for the engine of the motorcycle 10, the first fuel injector 50 is fixed to the cylinder head 32 of the engine 21 to inject fuel into the intake port 39 of the cylinder head 32 at a portion close to the intake valve, not shown, on the combustion chamber 52 side. Furthermore, in the electronic control throttle body unit 24, the throttle valve 25 incorporated in the throttle body 26 is opened and closed by driving the drive motor 27. Thus, the favorable engine speed response can be maintained during the throttle valve operation.

In the present embodiment, in the motorcycle 10, the partition wall 46 that divides the intake air is provided in the air funnel 37 arranged in the clean-side chamber of the air cleaner 20 at a position exposed to the fuel spray from the second fuel injector 51. The flow of the intake air passing through the air cleaner 20 and guided into the air funnel 37 is less deflected by the partition wall 46 in the air funnel 37, and the pressure loss due to the flow of the intake air in the intake passage 40 is decreased, thus being advantageous.

In the case of no location of the partition wall 46, the flow velocity on the vehicle front side of the air funnel 37 is decreased, and the controllability is deteriorated due to the fuel adhered to the wall surface. On the contrary, in the case of providing the partition wall 46, the flow velocity at the wall surface can be increased even if the fuel spray adheres, thereby increasing the controllability. Furthermore, by injecting fuel from the second fuel injector 51 toward the partition wall 46 at which the flow velocity is increased, the atomization of the fuel spray, and the mixing with the main stream in the air funnel 37 can be facilitated.

Furthermore, in the present embodiment, the electronic control throttle body unit 24 is employed in the engine intake system 23 of the motorcycle 10. The first and second fuel injectors 50 and 51, and the drive motor 27 of the electronic control throttle body unit 24 are both provided on the rear side of the intake passage 40. It is therefore not necessary to provide the first and second fuel injectors 50 and 51, and the drive motor 27 of the electronic control throttle body unit 24 between the intake passage 40 of down draft intake structure of the engine intake system 23 and the cylinder head cover 33 as shown in FIG. 4.

Moreover, since the second fuel injector 51 is arranged on the rear side of the air cleaner 20, no parts are required to be located between the intake passage 40 and the cylinder head cover 33, and the area of the cleaner filter 43 of the air cleaner 20 can be hence maximized as shown in FIG. 4. The dead space can be effectively utilized without decreasing the capacity of the air cleaner.

In the fuel injection device 22 for the engine 21, the second fuel injector 51 is disposed at a position at which the second fuel injector 51 does not block the effective flow of the intake air in the intake passage 40 of the air cleaner 20 even if the two fuel injectors 50 and 51 are provided. Therefore, since the second fuel injector 51 does not disturb the intake air into the air cleaner 20, an intake inertia effect is not deteriorated, and the engine power is not reduced.

Furthermore, since the partition wall 46 is provided in the air funnel 37, and the second fuel injector 51 injects fuel toward the funnel partition wall 46, the main stream of the intake air sucked into the air funnel 37 while circling in the air cleaner 20 is hardly deflected, and the main stream can be rectified by the partition wall 46. Since the partition wall 46 is arranged at the offset position within the air funnel 37, the main stream of the intake air rectified by the partition wall 46 disorders the flow when separated from the partition wall 46, and the flow of the separated vortex "F" can further facilitate the mixing between the fuel spray and the funnel main stream as shown in FIG. 5.

In the fuel injection device 22 for the engine of the motorcycle 10, the drive motor 27 of the electronic control throttle body unit 24 can be arranged by effectively utilizing the dead space between the air cleaner 20 and the fuel tank 19. The atmosphere temperature of the drive motor 27 of the electronic control throttle body unit 24 is thereby lowered. Accordingly, the mass can be concentrated, and the area of the cleaner filter 43 of the air cleaner 20 can be maximized, leading to the improvement of the travelling stability of the motorcycle.

In the fuel injection device 22 for the engine 21, the fuel is injected from the second fuel injector 51 against the partition wall 46 disposed in the air funnel 37, thereby further facilitating the atomization of the fuel spray and the mixing with the funnel main stream. Furthermore, the annular gap 53 surrounding the injector nozzle 51*a* of the second fuel injector 51 can also facilitate the mixing of the fuel spray due to the difference in flow velocity between the sub stream of the air blown out from the back side of the air funnel 37 and the funnel main stream by the ejector effect.

Furthermore, the drive motor 27 of the electronic control throttle body unit 24 and the first and second fuel injectors 50 and 51 are all arranged between the rear side of the intake passage 40 and the fuel tank 19. Therefore, the fuel pipe arranged from the fuel tank 19 to each of the fuel injectors 50 and 51 can be shortened. In addition, the fuel pressure pulsation can be thereby decreased, and the maintenance of the parts can be improved. The durability of the drive motor 27 of the electronic control throttle body unit 24 and the first and second fuel injectors 50 and 51 as precision parts can be improved because of the decrease in the temperature in the environment. The vehicle body can be downsized by effectively using the dead space, and the motion performance can be also improved by the concentration of the mass.

It is finally to be noted that the present invention is not limited to the described embodiment, and many other changes and modifications may be made without departing from the scope of the appended claims.

What is claimed is:

1. A fuel injection device for an engine of a motorcycle including an engine in which a plurality of cylinders are arranged in parallel with each other in a vehicle width direction, an air cleaner, a fuel tank arranged above the engine so as to cover the air cleaner, and the fuel injection device, the fuel injection device comprising:

an electronic control throttle body unit electrically controlling a throttle body of the engine and including a drive motor arranged between the intake passage and the fuel tank;

an intake passage of down draft intake structure connecting the air cleaner and a combustion chamber of the engine in each of the cylinders and extending from an air funnel incorporated in the air cleaner to an intake port of a cylinder head of the engine through the electronic control throttle body device; and a plurality of fuel injectors provided at the intake passage including a first fuel injector located on an intake downstream side and a second fuel injector located on an intake upstream side;

wherein the drive motor is arranged between the intake passage and the fuel tank and arranged on a same side as the first fuel injector and the second fuel injector and between the first and second fuel injectors, wherein the drive motor and the first and second fuel injectors are arranged on the rear side surface side and the fuel tank, and wherein the air funnel incorporated in a clean side of the air cleaner is provided with a partition wall configured to divide intake air and disposed at a position exposed to fuel injected from the second injector.

2. The fuel injection device for an engine of a motorcycle according to claim 1, wherein the first fuel injector is provided to the cylinder head on a vehicle front side relative to a rotation center axis of the drive motor.

3. The fuel injection device for an engine of a motorcycle according to claim 1, wherein the second fuel injector is configured to inject fuel into the air funnel by penetrating an air cleaner case and the air funnel from a back side of the air cleaner at a position closer to the engine than an upper end of the air funnel in vehicle side view.

4. The fuel injection device for an engine of a motorcycle according to claim 1, wherein the partition wall is arranged so as to extend in a direction of the intake passage in parallel with the vehicle width direction in the air funnel, and the partition wall is arranged at an offset position to a vehicle rear side with respect to a center line of the intake passage of the air funnel.

5. The fuel injection device for an engine of a motorcycle according to claim 1, wherein a boss-shaped cover wall that surrounds an outer periphery of a distal end of an injector nozzle is provided on the air funnel at an insertion hole portion for the second fuel injector, and an annular gap is formed at the outer periphery of the injector nozzle by the cover wall.

* * * * *